US007345647B1

(12) United States Patent
Rodenbeck

(10) Patent No.: US 7,345,647 B1
(45) Date of Patent: Mar. 18, 2008

(54) ANTENNA STRUCTURE WITH DISTRIBUTED STRIP

(75) Inventor: Christopher T. Rodenbeck, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 80 days.

(21) Appl. No.: 11/243,860

(22) Filed: Oct. 5, 2005

(51) Int. Cl.
*H01Q 1/36* (2006.01)

(52) U.S. Cl. ..... 343/895; 343/700 MS

(58) Field of Classification Search ..... 343/895, 343/700 MS, 702, 846, 767
See application file for complete search history.

(56) References Cited

U.S. PATENT DOCUMENTS

| | | | | |
|---|---|---|---|---|
| 5,532,708 | A | 7/1996 | Krenz et al. | |
| 5,703,932 | A | 12/1997 | Oda | |
| 6,045,652 | A | 4/2000 | Tuttle et al. | |
| 6,181,283 | B1 | 1/2001 | Johnson et al. | |
| 6,188,364 | B1 * | 2/2001 | Scordilis | 343/702 |
| 6,285,342 | B1 | 9/2001 | Brady et al. | |
| 6,424,301 | B1 | 7/2002 | Johnson et al. | |
| 6,466,169 | B1 * | 10/2002 | Harrell et al. | 343/700 MS |
| 6,518,937 | B2 * | 2/2003 | Fang | 343/895 |
| 6,535,166 | B1 | 3/2003 | Ali | |
| 6,661,381 | B2 | 12/2003 | Chen | |
| 6,670,922 | B1 * | 12/2003 | Huang et al. | 343/700 MS |
| 6,700,491 | B2 | 3/2004 | Shafer | |
| 6,747,600 | B2 | 6/2004 | Wong et al. | |
| 6,759,984 | B2 | 7/2004 | Wielsma | |
| 6,801,169 | B1 | 10/2004 | Chang et al. | |
| 6,853,335 | B1 | 2/2005 | Yeh | |
| 6,856,285 | B2 | 2/2005 | Bettin et al. | |
| 6,870,505 | B2 | 3/2005 | Aisenbrey | |
| 6,897,812 | B2 * | 5/2005 | Huang | 343/700 MS |
| 2002/0149521 | A1 * | 10/2002 | Hendler et al. | 343/700 MS |
| 2004/0150565 | A1 | 8/2004 | Paun | |
| 2005/0270243 | A1 * | 12/2005 | Caimi et al. | 343/702 |
| 2006/0001591 | A1 * | 1/2006 | Graggs et al. | 343/895 |

OTHER PUBLICATIONS

"Using Text as a Meander Line for RFID Transponder Antennas", Mikko Keskilammi, et al., IEEE Antennas and Wireless Propagation Letters, pp. 372-374, vol. 3, 2004.
"Gain-Optimized Self-Resonant meander Line Antennas for RFID Applications", Gaetano Marrocco, IEEE Antennas and Wireless Propagation Letters, pp. 302-305, vol. 2, 2003.
"Are Space-Filling Curves Efficient Small Antennas?", Jose M. Gonzalez-Arbesu, IEEE Antennas and Wireless Propagation Letters, pp. 147-150, vol. 2, 2003.
"A Planar Compact CPW-Fed Antenna", Proceedings of Asia-Pacific Microwave Conference, APMC2001, Dec. 3-6, 2001, pp. 934-937, vol. 2, 2001.

* cited by examiner

*Primary Examiner*—Huedung Mancuso
(74) *Attorney, Agent, or Firm*—William R. Conley

(57) ABSTRACT

An antenna comprises electrical conductors arranged to form a radiating element including a folded line configuration and a distributed strip configuration, where the radiating element is in proximity to a ground conductor. The folded line and the distributed strip can be electrically interconnected and substantially coplanar. The ground conductor can be spaced from, and coplanar to, the radiating element, or can alternatively lie in a plane set at an angle to the radiating element. Embodiments of the antenna include conductor patterns formed on a printed wiring board, having a ground plane, spacedly adjacent to and coplanar with the radiating element. Other embodiments of the antenna comprise a ground plane and radiating element on opposed sides of a printed wiring board. Other embodiments of the antenna comprise conductors that can be arranged as free standing "foils". Other embodiments include antennas that are encapsulated into a package containing the antenna.

8 Claims, 7 Drawing Sheets

ANTENNA STRUCTURE WITH DISTRIBUTED STRIP

STATEMENT REGARDING FEDERALLY SPONSORED RESEARCH OR DEVELOPMENT

The United States Government has certain rights in this invention pursuant to Department of Energy Contract No. DE-AC04-94AL85000 with Sandia Corporation.

FIELD OF THE INVENTION

The present invention relates to the design and construction of antennas that can be used to receive and/or transmit radio frequency signals. The present invention additionally relates to compact antennas having a distributed strip structure.

BACKGROUND OF THE INVENTION

Wireless communication systems operating at radio frequencies and having antennas, are demanding ever smaller form factors, as for example, in the field of radio frequency identification (RFID). RFID allows users to identify, locate, track and exchange information with remote assets. Typically in RFID applications a wireless communication device containing data, and including an antenna and a microchip and/or a surface acoustic wave (SAW) device, is attached to the item to be identified or tracked while a "host" reads and/or writes information to the device through the use of radio frequency communication. Applications for this technology are rapidly expanding across a range of economic sectors that include, manufacturing, retail, medical care, agriculture, transportation and environmental stewardship. In all these applications, compact low-profile RFID devices are highly valued, making reduced antenna size an area of great interest and endeavor.

BRIEF DESCRIPTION OF THE DRAWINGS

The accompanying drawings, which are incorporated in and form part of the specification, illustrate several embodiments of the present invention and, together with the description, serve to explain the principles of the invention. The drawings provided herein are not drawn to scale.

DETAILED DESCRIPTION OF THE INVENTION

In the design of antennas to be incorporated into hand-held, portable or small devices to be affixed to objects such as in radio frequency identification (RFID) the small form factor of the devices can require the antenna to fit within a space that can be much less than a quarter of the operating wavelength of the device. For example, for devices operating in the wavelength range of $\lambda$=3m to 0.15m (equivalent to an operational frequency range of 100 MHz to 200 GHz) the length of a ¼$\lambda$ (monopole) antenna would lie between 75 cm and 4 cm, and the length of a ½$\lambda$ (dipole) antenna would lie between 150 cm and 8 cm. As can readily be seen, ¼$\lambda$ and ½$\lambda$ antenna lengths are often much larger than the physical size of the device into which the antenna must fit. In an exemplary application such as an RFID device, functional limits on the size of an individual device can require an antenna to be very small, often less than 0.1$\lambda$ in overall length.

The present invention provides antennas that can be designed to fit within the small form factors (less than ¼$\lambda$) often required of wireless systems, by incorporating a conductor arranged in a distributed strip configuration with a conductor arranged in a folded line configuration in the radiating element of the antenna. The present invention does not require the use of coplanar waveguide and/or a microstrip feeds to the antenna. Many advantages of the present invention will become apparent in the exemplary embodiments presented herein. The following described embodiments present several variations of the invention and therefore serve to illustrate, but not limit, the scope of the invention.

Figure 1A:
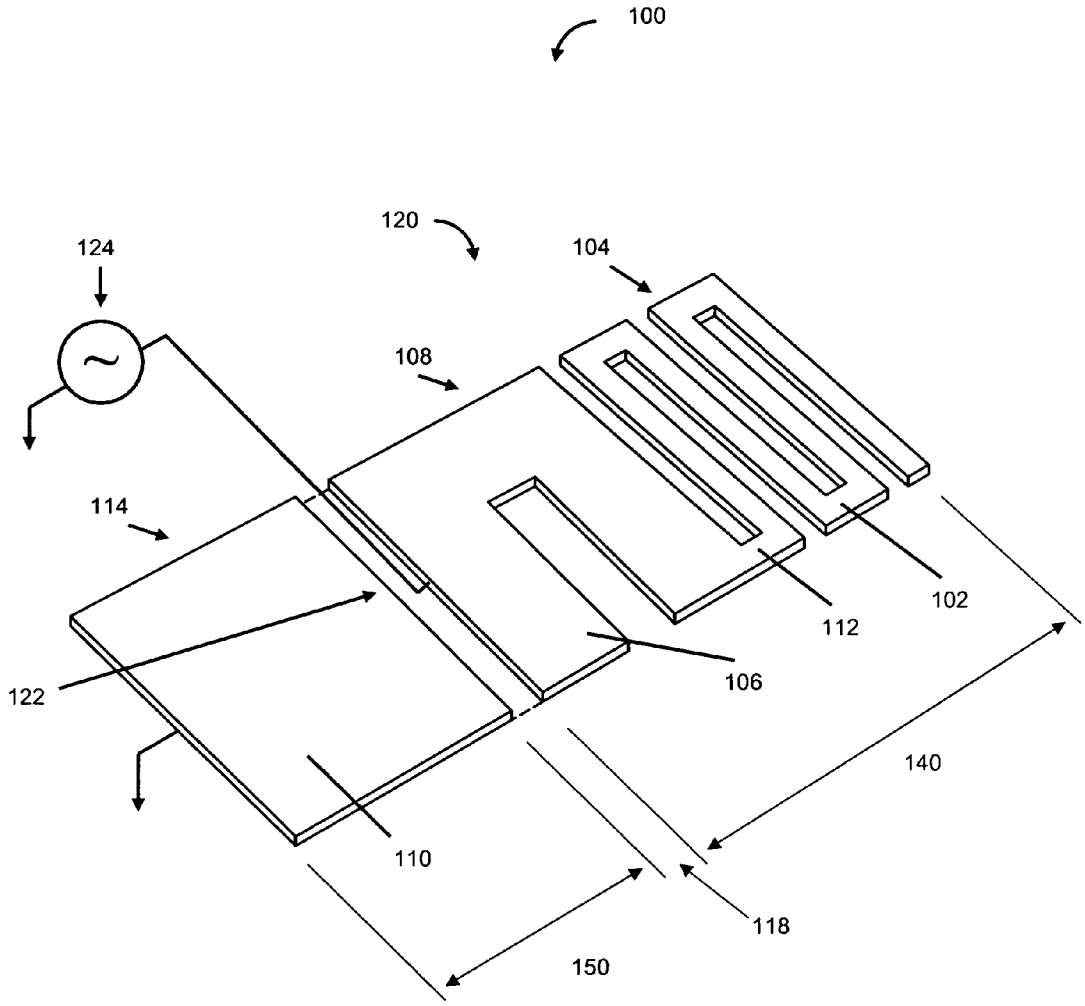
FIG. 1A is a schematic perspective view of an embodiment of an antenna according to the present invention.

FIG. 1A is a schematic perspective view of an embodiment of an antenna 100 according to the present invention. Antenna 100 comprises an electrical conductor 102 arranged in a folded line configuration 104 (e.g. a meander line) and an electrical conductor 106 arranged in a distributed strip configuration 108, and an electrical conductor 110 arranged as a ground plane 114. The electrical conductor 102 of the folded line configuration 104 is electrically connected to the electrical conductor 106 of the distributed strip configuration 108, for example at the connection 112. The radiating element 120 of the antenna 100 comprises the folded line configuration 104 and the distributed strip configuration 108. The radiating element 120 comprises at least two electrically connected conductors, having different line widths. The ground conductor 110 has no direct connection to either of the conductors 106 and 102, and is spaced from conductors 106 and 102 by a gap 118. The gap 118 can have a width as small as practically achievable in manufacturing the antenna, while the upper limit on the width of the gap is set by the requirement that the ground conductor 110 be electrically coupled, i.e. capacitively and/or inductively, but not directly connected to, the radiating element comprising conductors 102 and 106 of the antenna 100.

In the example embodiment, the electrical conductors 102, 106 and 110 are illustrated as comprising electrically conductive sheets or foils in free space, arranged to lie within a single plane. A signal feed 122 interconnecting the electronics 124 of a system to the antenna can be made at a location within the gap 118. In other embodiments as described below, the signal feed 122 can be interconnected to the radiating element 120 at virtually any other location along the conductors 106 and/or 102. The location of the signal feed 122 can be determined by convenience, for example by the relative orientation of the radiating element 120, to the location of the electronics 124 of a system. In this embodiment, the radiating element has a length 140, the ground a length of 150 and for convenience, the radiating element and the ground plane are illustrated as having equal widths.

Figure 1B:
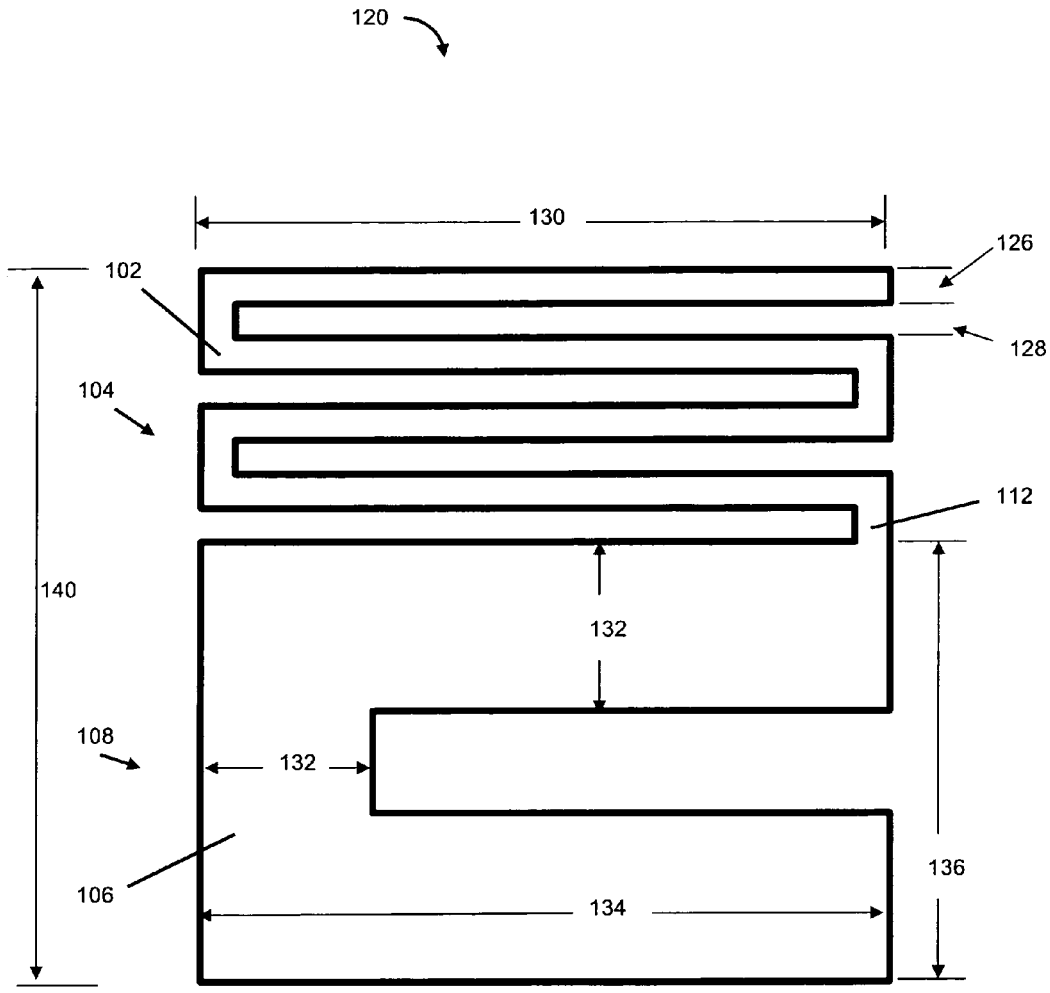
FIG. 1B is an enlarged schematic view of the radiating element of the antenna in FIG. 1A.

FIG. 1B is a enlarged scale schematic illustration of the radiating element 120 of the antenna 100 as shown in FIG. 1A. In this embodiment, the folded line configuration 104 has a width 130 and comprises two turns (N=2) of the conductor 102, wherein the conductor has a width 126 and adjacent legs of the turns are spaced by the distance 128. The number of turns is two for illustrative purposes only. Other embodiments can have many turns, for example N=11, eleven turns, as described below. The folded line configuration 104 comprises a conductor 102, for example a wire, metal trace or foil, that is repeatedly folded, in this example, in a two dimensional plane. The folding of the conductor 102 into a folded line configuration primarily adds inductive loading to the radiating element, and reduces the antenna's physical size in comparison with a conventional resonant dipole antenna. The folding of the conductor 102 maintains a long "running length", or electrical length, of the conductor within a compact area.

In FIG. 1B the distributed strip configuration 108 has a width 134, length 136, and comprises a conductor 106 having a width 132. The distributed strip configuration 108 primarily adds capacitance to the antenna, and can eliminate the need for impedance matching components (such as capacitors, inductors and resistors) for matching the impedance of the electronics of a system to the impedance of an antenna, and as illustrated in an exemplary application below, the distributed strip configuration 108 allows for realizing the antenna in a small form factor ($<\frac{1}{4}\lambda$) while maintaining manufacturable dimensions within the layout and construction of an antenna. The width 132 of conductor 106 in the distributed strip configuration is greater than the width 126 of the conductor 102 of the folded line configuration. In other embodiments, the width 132 is at least ten times greater than the width 126. In still other embodiments, the width of the conductor 106 can equal the full width 134 of the distributed strip configuration 108 (for example, the distributed strip configuration would have no gap or slot intruding the conductor 106). The width 134 of the distributed strip configuration 108 can, for convenience, be set equal to the width 130 of the folded line configuration 104 (as shown in FIG. 1B). The distributed strip can comprise any geometrical shape of convenience, for example a triangle, circle, trapezoid or ellipse. In this embodiment the folded line configuration 104, distributed strip configuration 108 and the ground configuration 114 are arranged to be coplanar and aligned along the length of the antenna.

Within the folded line configuration 104, the width 126 of the of the conductor 102, the spacing 128 between adjacent legs, the overall width of the folded line configuration 130, and layout of the folded line configuration (i.e. meander pattern as shown, serpentine, spiral and helical patterns are also possible) in combination with the layout of the distributed strip configuration determines the antenna's resonant frequency and performance characteristics. In other embodiments, it can be desired to encapsulate the antenna within a dielectric medium (not shown) for reasons such as environmental protection or to create a form factor suitable to a next assembly. Suitable encapsulants can include polymers, glasses, ceramics, glass-ceramics and composite materials.

Figure 2A:
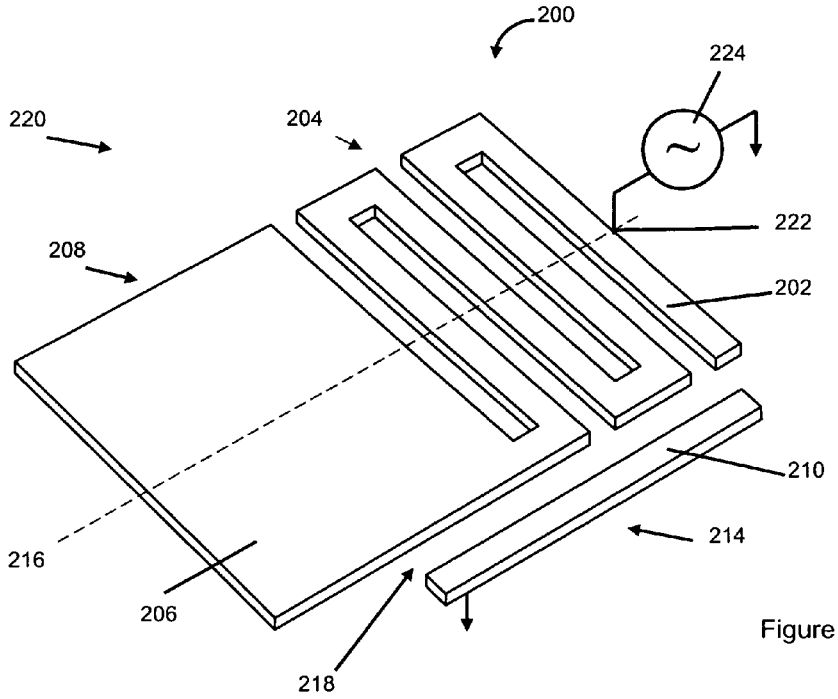
FIGS. 2A through 2C are schematic perspective views of embodiments of antennas according to the present invention.
Figure 2B:
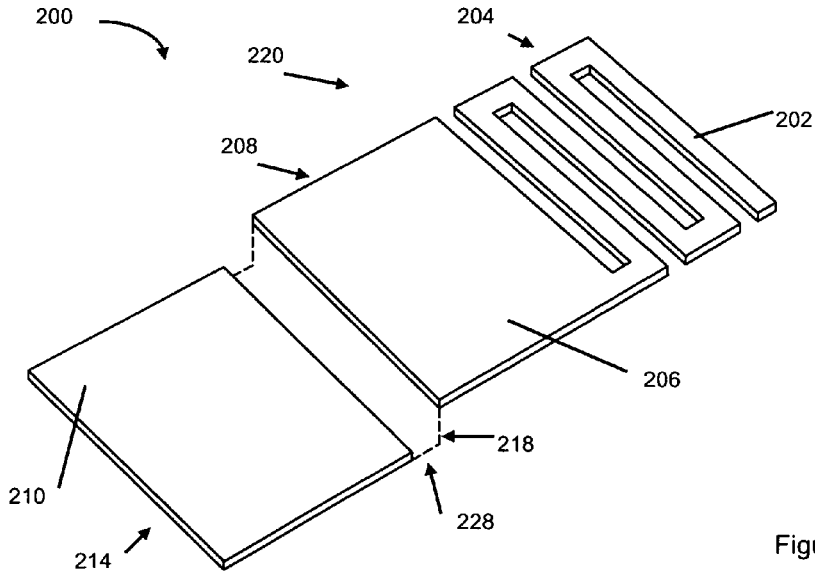
Figure 2C:
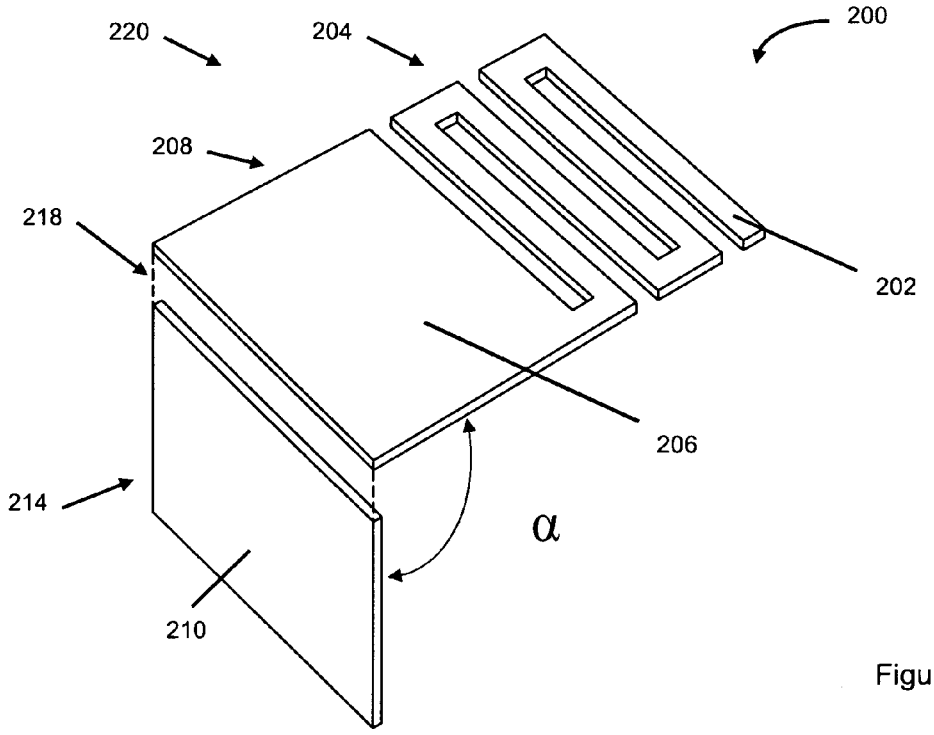

FIGS. 2A, 2B and 2C are schematic perspective views of other embodiments of antennas according to the present invention, wherein alternate arrangements of the ground conductor 210 relative to the radiating element 220 of an antenna 200 are illustrated.

FIG. 2A illustrates an embodiment where the conductor 210 comprising the ground 214 is not located along the same axis 216 as the radiating element 220. The ground conductor 210 is spaced from the radiating element 220 by a gap 218 (as described above). The gap need not be uniform as illustrated in FIG. 2A, but could for example, be tapered from end to end. In FIG. 2A, a signal feed 222 can be located along the conductor 202 within the folded line configuration 204. Locating the signal feed within the folded line configuration can be convenient depending on the relative orientation of the radiating element 220 with respect to a systems electronics 224. In other applications, locating the signal feed within the distributed strip configuration 208 has been found to facilitate "fine tuning" of an antenna, by allowing access for trimming the length of the conductor 202 within the folded line configuration.

FIG. 2B illustrates an embodiment where the ground conductor 210, configured as a ground plane 214, lies within a plane spaced by a distance 218 from the plane containing the radiating element 220, as can occur for example, in an application where the radiating element 220 and the ground conductor 210 lie on separate boards within a system, or are disposed on separate portions or surfaces of a case or housing. In this embodiment, the ground plane configuration 214 is substantially parallel to the plane containing the folded line 204 and distributed strip 208 configurations. This arrangement can occur for example, where a board or housing upon which one of the conductors (202, 206, 210) is disposed comprises a curvature or shape causing deviations from the geometrically ideal, infinitely parallel condition. Such deviations can be accommodated for in the design of the layout of the antenna and are of no significance to the present invention.

The edge of the ground plane configuration can additionally be spaced by a distance, or gap 228, from the edge of the radiating element 220. The gap 228 can be used to prevent portions of the ground plane configuration 214 from overlaying portions of the radiating element 220. If for example, a substantial portion of the ground plane configuration 214 were to overlay the radiating element 220, the electrical length of the radiating element as measured along its primary axis would effectively be reduced, and this would need to be compensated for in the design of the antenna. As defined and used herein the ground conductor 210 is said to be laterally separated from the conductors 202 and 206 comprising the radiating element, wherein the ground conductor 210 does not substantially overlay either of the conductors 206 or 202. This definition applies equally well in embodiments where conductors are arranged to lie within a common plane as for example, in FIGS. 1A, 2A, 3, 4A, 5, 7 and 8, as well as those embodiments where conductors are arranged to lie within more than one plane as for example, in FIGS. 2B, 2C and 6.

FIG. 2C illustrates an embodiment where the ground conductor 210, configured as a ground plane 214, lies within a plane spaced by a distance 218, and arranged at an angle $\alpha$, from the plane containing the radiating element 220, as can occur for example, in an application where it is desired to have the radiating element 220 stand out and away from a surface of the system within which the antenna is housed. The angle $\alpha$ can be ninety degrees for example, where it is desired to maximize the height of the radiating element above a system board.

Figure 3:
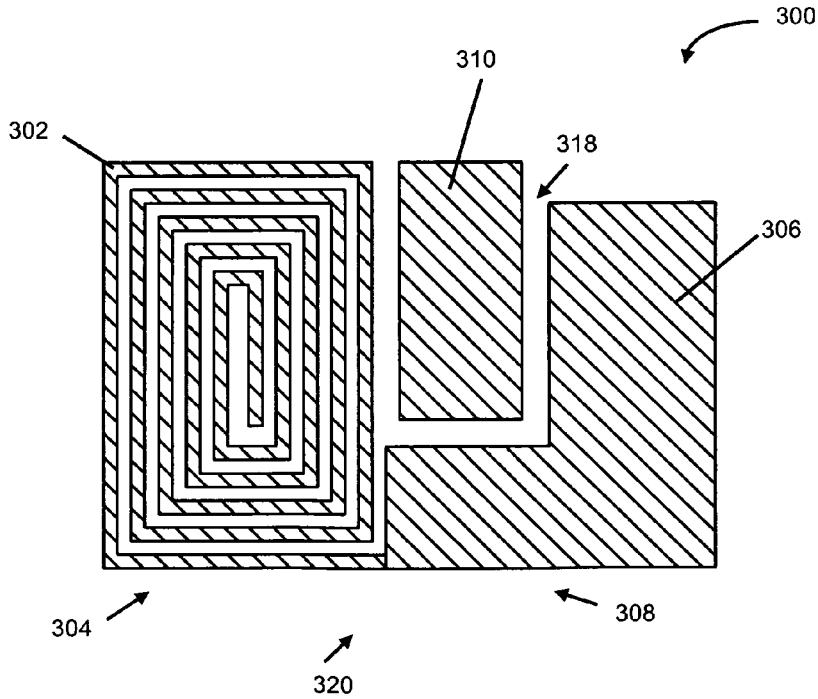
FIG. 3 is a schematic illustration of another embodiment of an antenna according to the present invention.

FIG. 3 is a schematic illustration of another embodiment of an antenna 300 according to the present invention. Antenna 300 comprises a radiating element 320, having a folded line configuration 304 wherein conductor 302 is arranged in a spiral configuration, a distributed strip configuration 308 having conductor 306, and a ground comprising a conductor 310 spaced from conductors 306 and 302 by a gap 318. FIG. 3 serves to illustrate an embodiment where the layout of the ground conductor 310 intrudes into the layout of the radiating element 320, while not directly contacting the conductors 306 or 302.

Figure 4A:
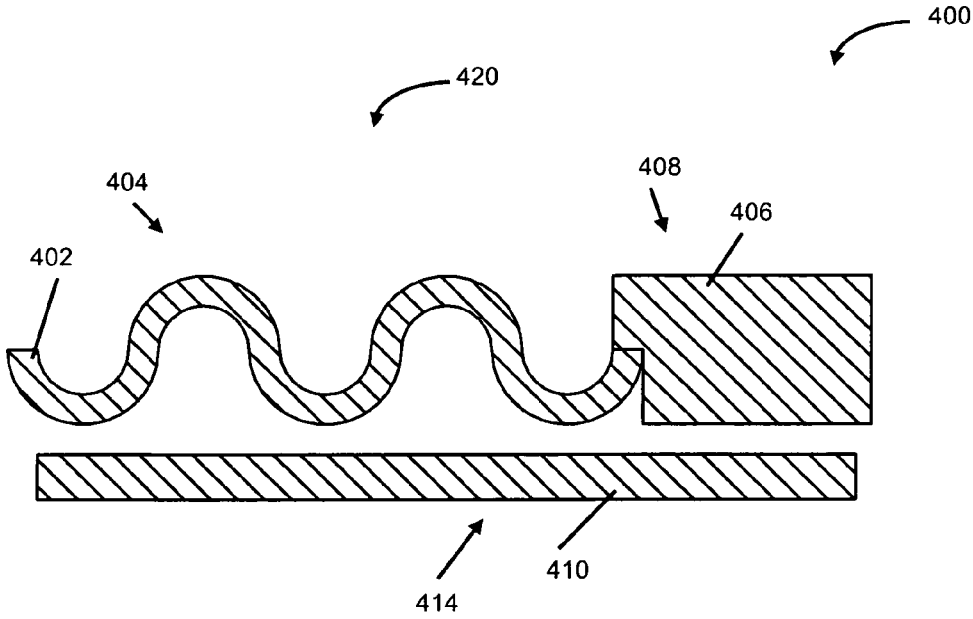
FIGS. 4A and 4B are schematic illustrations of additional folded line configurations as can be used in antennas according to the present invention.
Figure 4B:
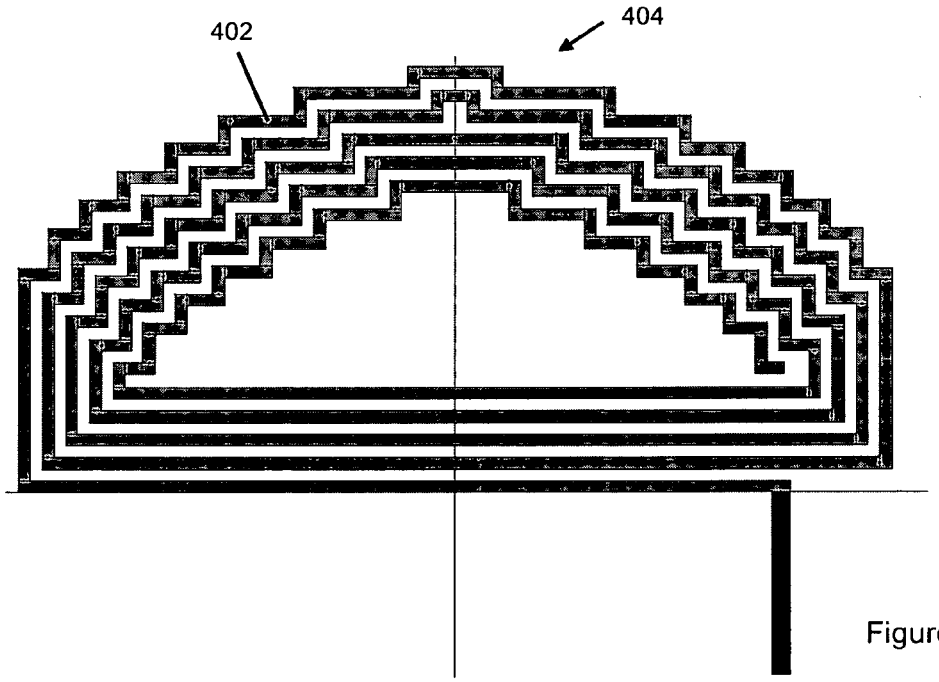

FIGS. 4A and 4B are schematic illustrations of folded line configurations as can be found in antennas according to the present invention. In FIG. 4A antenna 400 comprises a radiating element 420 having conductor 402 arranged in a serpentine folded line configuration 404, electrically connected to a distributed strip configuration 408 comprising conductor 406. Ground conductor 410 is not directly connected to either of the conductors 402 or 406, comprising the radiating element 420.

FIG. 4B illustrates another embodiment of a folded line configuration 404 comprising conductor 402 arranged in a spiral configuration. Examples of folded line configurations include conductors arranged as meander lines, loops, serpentine lines, spirals (round or square), and helixes as can be formed of vertically interconnected conductor portions on multiple layers of a printed wiring board.

Figure 5:
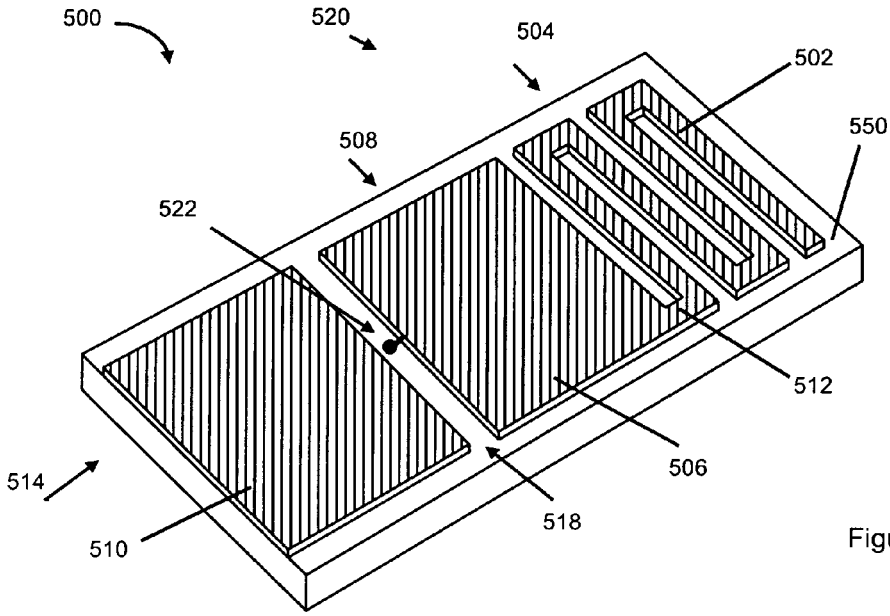
FIGS. 5 and 6 are schematic perspective views of embodiments of antennas produced on planar dielectric substrates, according to the present invention.

FIG. 5 is a schematic perspective illustration of an embodiment of an antenna 500 according to the present invention, as constructed on a dielectric substrate, for example a printed wiring board 550. In this embodiment the conductors 502, 506, and 510, arranged respectively as folded line 504, distributed strip 508 and ground plane 514 configurations, are disposed on a surface of the printed wiring board 550. A signal feed 522 to the antenna can be provided by an electrical via through the printed wiring board 550, disposed within the gap 518 between the ground plane configuration and the distributed strip configuration. This would allow for example, placing electrical components (not shown) on the opposed side of the printed wiring board 550.

Examples of materials that dielectric substrate 550 can comprise include but are not limited to: ceramics and glasses, such as alumina, beryllium oxide, silicon nitride, aluminum nitride, titanium nitride, titanium carbide, silicon carbide, diamond and diamond like substrates, glass-ceramic composite, low temperature co-fired ceramic multilayered material or high-temperature co-fired ceramic multilayered material; polymers such as a plastic, glass-polymer composite, a resin material, a fiber-reinforced composite, a printed wiring board composition, epoxy-glass composite, epoxy-polyimide composite, polyamide, fluoropolymer, polyether ether ketone or polydimethylsiloxane; and insulated metal substrates such as a glass-coated metal.

Figure 6:
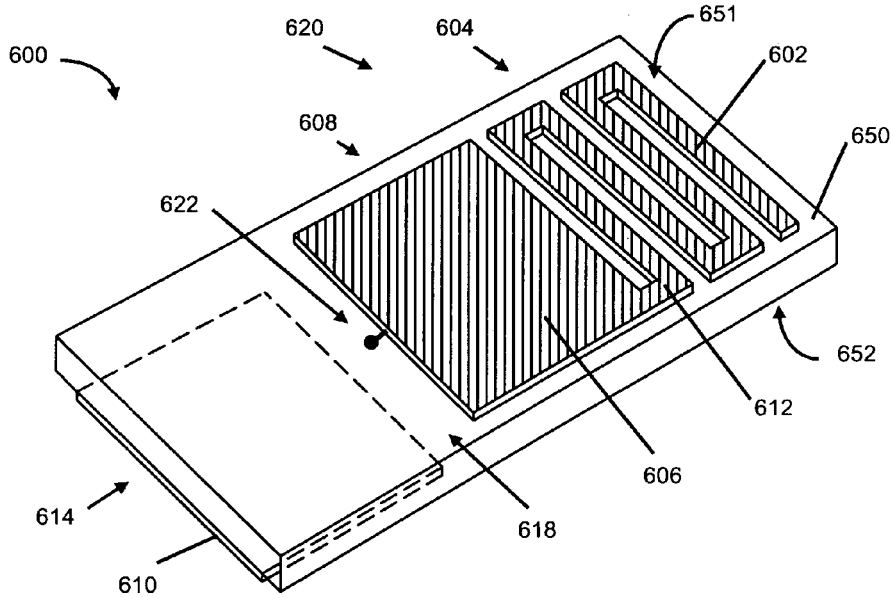

FIG. 6 is a schematic perspective illustration of an antenna 600 according to the present invention, constructed on a dielectric substrate, for example a printed wiring board 650. In this embodiment the conductors 602 and 606 are arranged respectively as folded line 604, and distributed strip 608 configurations, and are disposed on one side 651 of the printed wiring board 650, while a conductor 610 arranged as a ground plane configuration 614 is disposed on the opposed side 652 of the board. The ground plane configuration 614 is positioned relative to the radiating element 620 of the antenna (e.g. with a lateral spacing 618), so that portions of the folded line 604 and distributed strip 608 configurations do not substantially overlay the ground plane configuration 614. A substantial amount of overlay is one that would degrade the electrical performance of the antenna by an amount unacceptable to the requirements of the system. In this example, the gap 618 is maintained between the edge of the radiated element 620 and the ground plane configuration 614. A signal feed 622 to the antenna can be provided within the gap 618 between the ground plane configuration 622 and the distributed strip configuration 608.

Figure 7:
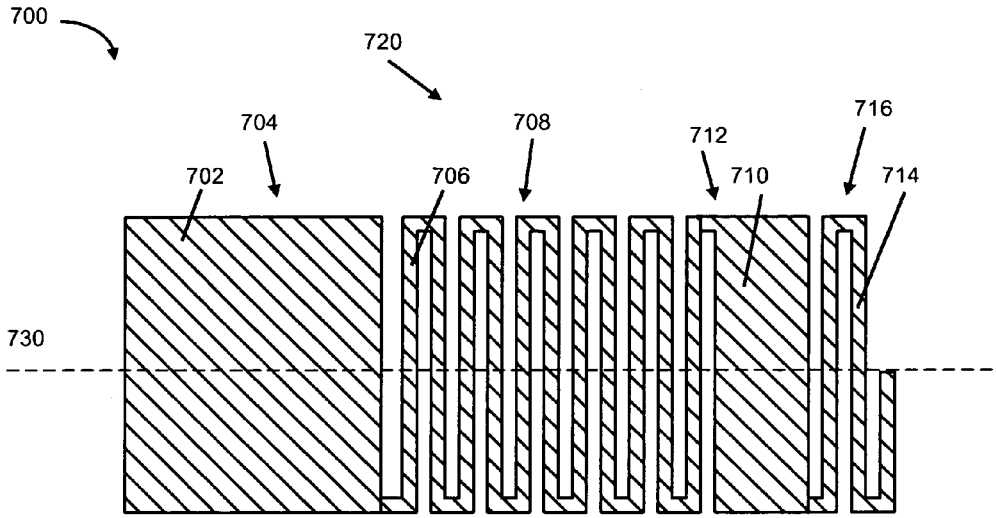
FIGS. 7 and 8 are schematic illustrations of embodiments of radiating elements as can be used in antennas according to the present invention.

FIG. 7 is a schematic illustration of another embodiment of an antenna 700, according to the present invention. In this embodiment, the radiating element 720 of antenna 700 comprises multiple distributed strip configurations 704 and 712, interconnected with multiple folded line configurations, 708 and 716, and arranged to lie along an axis 730. A ground configuration not shown, could be provided for example, on the same surface (or an opposed surface) of a dielectric upon which the conductors 702, 706, 710 and 714 reside. Multiple folded line configurations that are not necessarily identical, as well as multiple distributed strip configurations that are not necessarily identical (i.e. differing conductor widths and/or lengths, configuration widths and/or lengths) can be used where it is desired to broaden the bandwidth of the antenna. Electrical connection to the radiating element 720 can be made at any point along the conductors 702, 706, 710 and 714 and can be determined, by convenience and proximity to the electronics of a system. In other embodiments, an electrical connection can be made to the antenna along an edge of the conductor 702, to allow fine tuning of the antenna's electrical performance by trimming the length of the electrical conductor 714.

Figure 8:
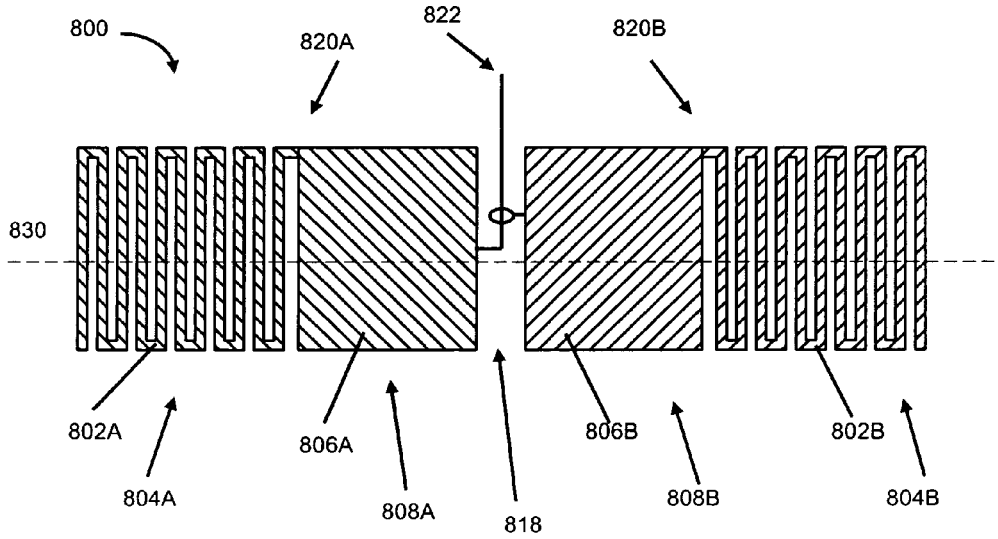

FIG. 8 is a schematic illustration of another embodiment of an antenna 800 according to the present invention. Antenna 800 comprises two radiating elements 820*a* and 820*b*, spaced apart by the gap 818 and arranged along an axis 812. An antenna feed 822 can be located within the gap 818. The gap can range in size from as small as manufacturing permits with the upper end on the gap size being established by the requirement that the radiating elements be electrically connected (i.e. capacitively and/or inductively). Each radiating element comprises a conductor, 806*a* and 806*b*, arranged in a distributed strip configuration 808*a* and 808*b*, and a conductor 802*a* and 802*b* arranged in a folded line configuration 804*a* and 804*b*. It is not necessary that the two radiating elements 820*a* and 820*b* be symmetrical, nor is it necessary that the two radiating elements be oriented so as to have their respective distributed strip configurations 808*a* and 808*b*, to be adjacent. In some applications, orienting the two radiating elements 820*a* and 820*b* as shown in FIG. 8 (adjacent distributed strip configurations) can allow for fine tuning of the antenna's resonant frequency by trimming the length of the conductors 802*a* and 802*b* in the folded line configurations, 804*a* and 804*b*.

In an exemplary application, an antenna was produced in accordance with the present invention and as schematically illustrated in FIG. 6. A radiating element was formed as an etched copper pattern on one side of an epoxy—glass printed wiring board and a ground plane formed as an etched copper pattern on the opposed side of the board. The antenna was designed to resonate at 433 MHz and be matched to an impedance of 50 ohms. This frequency (433 MHz) is heavily used for short-range wireless devices and RFID systems and provides an effective demonstration of this invention at a wavelength where significant size reductions are desired. Modeling the characteristics of the antenna versus the layout, i.e the physical, parameters of the antenna, was accomplished by a numerical method known as the "method of moments" that is embodied in commercially available software. Using the method of moments methodology, the layout parameters of an antenna as listed in Table I, were determined to provide the desired resonant frequency and impedance.

TABLE I

| Antenna Physical Dimensions (433 MHz, 50 Ohm Impedance) | |
|---|---|
| Printed Wiring Board Thickness | 0.5 mm |
| Width of antenna | 25 mm |
| Folded Line Configuration | Meander |
| Number of Turns in Folded Line Configuration | 11 |
| Width of Conductor in Folded Line Configuration | 0.25 mm |
| Spacing Between Adjacent Conductor Legs in Folded Line Configuration | 0.5 mm |
| Length of Capacitive Strip Configuration | 10.75 mm |
| Length of Ground Plane | 98.5 mm |
| Total Length of Radiating Element | 2.71 cm (0.039 wavelengths) |

The thickness of the printed wiring board, i.e dielectric substrate, has little impact on the performance of the antenna, and was selected as a matter of convenience for the present application. The width and length of the antenna were established by the physical constraints of the system within which the antenna was required to fit. The width of the folded line configuration, the capacitive strip configuration and the ground configuration were set to equal the width of the antenna. The parameters that were adjustable in the model of the antenna were the number of turns in the folded line configuration, the width of the conductor within the folded line configuration, the spacing between adjacent conductor legs in the folded line configuration and the length of the capacitive strip configuration. As can be seen in Table I, the overall form factor for the antenna is very compact, for example, the length of the radiating element is 0.039λ, and the width of the antenna is 25 mm, while the width of the conductor in the folded line configuration is 0.25 mm and the spacing between adjacent legs in the folded line configuration is 0.5 mm, which are easily manufactured in a printed wiring board technology.

The above described exemplary embodiments present several variants of the invention but do not limit the scope of the invention. Those skilled in the art will appreciate that the present invention can be implemented in other equivalent ways. The actual scope of the invention is intended to be defined in the following claims.

What is claimed is:

1. An antenna comprising:

a radiating element comprising, a first electrical conductor having a first width, the first electrical conductor arranged in a folded line configuration, the folded line configuration having a second width;

a second electrical conductor having a third width, the second electrical conductor electrically connected to, and coplanar with, the first electrical conductor, the second electrical conductor arranged in a distributed strip configuration, the distributed strip configuration having a fourth width and, the third width of the second electrical conductor greater than the first width of the first electrical conductor; and, a ground comprising a third electrical conductor laterally separated from the first and second electrical conductors, the third electrical conductor not directly contacting the first and second electrical conductors wherein the first and second electrical conductors lie within a first plane and the third electrical conductor lies within a second plane, the first plane being parallel to, and spaced from, the second plane.

2. An antenna comprising:

a radiating element comprising, a first electrical conductor having a first width, the first electrical conductor arranged in a folded line configuration, the folded line configuration having a second width;

a second electrical conductor having a third width, the second electrical conductor electrically connected to, and coplanar with, the first electrical conductor, the second electrical conductor arranged in a distributed strip configuration, the distributed strip configuration having a fourth width and, the third width of the second electrical conductor greater than the first width of the first electrical conductor, and, a ground comprising a third electrical conductor laterally separated from the first and second electrical conductors, the third electrical conductor not directly contacting the first and second electrical conductors, wherein the first, second and third electrical conductors lie within a plane; and, the folded line configuration comprises a first edge;

the distributed strip configuration comprises a second edge and an opposed third edge, the first edge of the folded line configuration disposed adjacent to the second edge of the distributed strip configuration; and, the ground comprises the third electrical conductor arranged in a ground plane configuration, the ground plane configuration having a fourth edge, the fourth edge of the ground plane configuration disposed spacedly adjacent to the third edge of the distributed line configuration, thereby forming a gap between the distributed line configuration and the ground plane configuration.

3. The antenna of claim 2 comprising a signal feed, the signal feed being disposed within the gap between the distributed line configuration and the ground plane configuration.

4. The antenna of claim 2 wherein the ground plane configuration comprises a fifth width, the fifth width of the ground plane configuration and the second width of the folded line configuration and the fourth width of the distributed strip configuration being equal and, the ground plane configuration and the folded line configuration and the distributed strip configuration being aligned along a common axis.

5. An antenna comprising:

a radiating element comprising, a first electrical conductor having a first width, the first electrical conductor arranged in a folded line configuration, the folded line configuration having a second width;

a second electrical conductor having a third width, the second electrical conductor electrically connected to, and coplanar with, the first electrical conductor, the second electrical conductor arranged in a distributed strip configuration, the distributed strip configuration having a fourth width and, the third width of the second electrical conductor greater than the first width of the first electrical conductor; and, a ground comprising a third electrical conductor laterally separated from the first and second electrical conductors, the third electrical conductor not directly contacting the first and second electrical conductors wherein the third width of the second electrical conductor is at least ten times greater than the first width of the first electrical conductor.

6. The antenna of claim 2 wherein the ground plane configuration comprises a grid pattern.

7. An antenna comprising:

a dielectric having a first surface and a second surface, and a body there between;

a radiating element comprising, a first electrical conductor having a first width, disposed on the first surface of the dielectric substrate, the first electrical conductor arranged in a folded line configuration, the folded line configuration having a second width;

a second electrical conductor having a third width, disposed on the first surface of the dielectric substrate, the second electrical conductor electrically connected to the first electrical conductor, the second electrical conductor arranged in a distributed strip configuration adjacent to the folded line configuration, the distributed strip configuration having a fourth width and, the third width of the second electrical conductor greater than the first width of the first electrical conductor; and, a ground comprising a third electrical conductor including one or more selected from the group consisting of an electrical conductor disposed on the first surface of the dielectric, an electrical conductor disposed on the second surface of the dielectric, and an electrical conductor disposed within the body of the dielectric, the third electrical conductor laterally separated from the first and second electrical conductors, and the third electrical conductor not directly contacting the first and second electrical conductors wherein the third width of the second electrical conductor is at least ten times greater than the first width of the first electrical conductor.

8. An antenna comprising:

a first portion comprising, a first electrical conductor having a first width, the first electrical conductor arranged in a first folded line configuration, the first folded line configuration having a second width;

a second electrical conductor having a third width, the second electrical conductor electrically connected to, and coplanar with, the first electrical conductor, the second electrical conductor being arranged in a first distributed strip configuration, the first distributed strip configuration having a fourth width, the third width of the second electrical conductor being greater than the first width of the first electrical conductor and, the first distributed strip configuration being disposed adjacent to the first folded line configuration;

a second portion comprising, a third electrical conductor having a fifth width, the third electrical conductor arranged in a second folded line configuration, the second folded line configuration having a sixth width;

a fourth electrical conductor having a seventh width, the fourth electrical conductor electrically connected to, and coplanar with, the third electrical conductor, the fourth electrical conductor being arranged in a second distributed strip configuration, the second distributed strip configuration having an eighth width, the seventh width of the fourth electrical conductor being greater than the fifth width of the third electrical conductor and, the second distributed strip configuration being disposed adjacent to the second folded line portion wherein the third width of the second electrical conductor is at least ten times greater than the first width of the first electrical conductor and, the seventh width of the fourth electrical conductor is at least ten times greater than the fifth width of the third electrical conductor.

* * * * *